US008994257B2

(12) United States Patent
Ishiguro et al.

(10) Patent No.: US 8,994,257 B2
(45) Date of Patent: Mar. 31, 2015

(54) SPARK PLUG FOR INTERNAL COMBUSTION ENGINE AND METHOD FOR MANUFACTURING SAME

(71) Applicant: Denso Corporation, Kariya (JP)

(72) Inventors: Hiroya Ishiguro, Kariya (JP); Masaya Nakamura, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/780,682

(22) Filed: Feb. 28, 2013

(65) Prior Publication Data

US 2013/0221832 A1 Aug. 29, 2013

(30) Foreign Application Priority Data

Feb. 28, 2012 (JP) ..... 2012-041452

(51) Int. Cl.
*H01T 21/02* (2006.01)
*H01T 13/02* (2006.01)
*H01T 13/39* (2006.01)

(52) U.S. Cl.
CPC ..... *H01T 21/02* (2013.01); *H01T 13/39* (2013.01); *H01T 13/02* (2013.01)
USPC ..... 313/144; 445/7

(58) Field of Classification Search
USPC ..... 313/144; 445/7
See application file for complete search history.

(56) References Cited

U.S. PATENT DOCUMENTS 6,078,129 A * 6/2000 Gotou et al. ..... 313/141
6,215,235 B1 * 4/2001 Osamura ..... 313/141
6,533,628 B1 * 3/2003 Matsutani ..... 445/7
6,597,089 B2 * 7/2003 Matsutani ..... 313/141
6,653,766 B2 * 11/2003 Hori ..... 313/141
6,705,009 B2 * 3/2004 Niessner ..... 29/879
6,819,031 B2 * 11/2004 Hori ..... 313/141
6,831,397 B2 * 12/2004 Kanao et al. ..... 313/141
6,833,658 B2 * 12/2004 Niessner ..... 313/141
6,846,214 B1 * 1/2005 Gotou et al. ..... 445/7

(Continued)

FOREIGN PATENT DOCUMENTS

JP 3121309 10/2000
JP 2001-015245 1/2001

(Continued)

OTHER PUBLICATIONS

Information Offer Form (18 pages), dated Oct. 21, 2014, issued in corresponding Japanese Application No. 2012-041452 and English translation (18 pages).

*Primary Examiner* — Mariceli Santiago
*Assistant Examiner* — Jacob R Stern
(74) *Attorney, Agent, or Firm* — Nixon & Vanderhye PC

(57) ABSTRACT

The spark plug has a configuration satisfying the relationships of B≥0.7A and 0.3 mm≤A≤0.6 mm, where B is an axial thickness along the central axis line Q of the weld portion formed between the base material electrode and the noble-metal chip, and A is an axial distance along the central axis line Q between the intersection points P3 and X. The intersection point P3 is a point at which a phantom axis line radially distant from the central axis line Q by D/2 (D being a diameter of the noble-metal chip) intersects with the boundary line between the weld portion and the noble-metal chip. The intersection point X is a point at which an extension of the contour line of the base material electrode in the vicinity of the weld portion intersects with a boundary line between the weld portion and the base material electrode.

4 Claims, 9 Drawing Sheets

(56) References Cited

U.S. PATENT DOCUMENTS

| | | | | |
|---|---|---|---|---|
| 6,853,116 | B2 * | 2/2005 | Hori et al. | 313/141 |
| 6,885,137 | B2 * | 4/2005 | Kanao et al. | 313/141 |
| 6,891,318 | B2 * | 5/2005 | Hori et al. | 313/141 |
| 6,997,767 | B2 * | 2/2006 | Taniguchi et al. | 445/7 |
| 7,083,488 | B2 * | 8/2006 | Taniguchi et al. | 445/7 |
| 7,199,511 | B2 * | 4/2007 | Hori | 313/143 |
| 7,321,187 | B2 * | 1/2008 | Teramura et al. | 313/141 |
| 7,666,047 | B2 * | 2/2010 | Suzuki et al. | 445/7 |
| 8,026,654 | B2 * | 9/2011 | Kowalski et al. | 313/144 |
| 8,115,372 | B2 * | 2/2012 | Kameda | 313/143 |
| 8,264,131 | B2 * | 9/2012 | Sakayanagi et al. | 313/141 |
| 8,410,673 | B2 * | 4/2013 | Torii et al. | 313/141 |
| 8,476,817 | B2 * | 7/2013 | Miyashita et al. | 313/141 |
| 2005/0057133 | A1 * | 3/2005 | Hori | 313/141 |
| 2010/0101073 | A1 | 4/2010 | Kato et al. | |
| 2010/0253203 | A1 * | 10/2010 | Suzuki et al. | 313/141 |
| 2011/0043093 | A1 | 2/2011 | Nunome | |
| 2011/0148276 | A1 * | 6/2011 | Sakayanagi et al. | 313/141 |
| 2012/0001533 | A1 * | 1/2012 | Sakayanagi et al. | 313/141 |

FOREIGN PATENT DOCUMENTS

| | | |
|---|---|---|
| JP | 2008-270185 | 11/2008 |
| JP | 2011-034826 | 2/2011 |
| WO | WO2009/063976 | 5/2009 |
| WO | WO2009/130909 | 10/2009 |

* cited by examiner

SPARK PLUG FOR INTERNAL COMBUSTION ENGINE AND METHOD FOR MANUFACTURING SAME

This application claims priority to Japanese Patent Application No. 2012-41452 filed on Feb. 28, 2012, the entire contents of which are hereby incorporated by reference.

BACKGROUND OF THE INVENTION

1. Field of the Invention

The present invention relates to a spark plug for use in an internal combustion engine of an automobile, a cogeneration apparatus, a gas feed pump, etc., and to a method of manufacturing the spark plug.

2. Description of Related Art

Generally, a spark plug for use in an internal combustion engine includes a center electrode, an insulator disposed around the outer periphery of the center electrode, a mounting bracket disposed around the outer periphery of the insulator, and a ground electrode disposed so as to extend from the mounting bracket and form a spark discharge gap with the center electrode. It is known to provide such a spark plug with a highly durable noble-metal chip at the spark discharge gap thereof. For example, refer to Japanese Patent Application Laid-open No. 2011-34826.

Incidentally, since the joining between the noble-metal chip and the center electrode or ground electrode as a base material electrode is performed by welding, a weld portion is formed therebetween. Accordingly, to achieve high durability thanks to the noble-metal chip, the reliability between the noble-metal chip and the base material electrode through the weld portion has to be sufficiently high.

SUMMARY

An exemplary embodiment provides a spark plug for an internal combustion engine comprising:

a center electrode;

an insulator disposed around an outer periphery of the center electrode;

a mounting bracket disposed around an outer periphery of the insulator;

a ground electrode disposed so as to extend from the mounting bracket and form a spark discharge gap with the center electrode; and a columnar noble-metal chip having a diameter of D and joined, through a weld portion, to a distal end of at least one of the center electrode and the ground electrode as a base material electrode, wherein, when Q designates a central axis line of the noble-metal chip, P0 designates an intersection point in a cross-section of the noble-metal chip passing through the central axis line Q at which the central axis line Q intersects with a boundary line designated by D/4 between the weld portion and the noble-metal chip, P1 designates an intersection point at which a phantom axis line designated by Q1 which is radially distant from the central axis line Q by D/4 intersects with the boundary line S1, P2 designates an intersection point at which a phantom axis line designated by Q2 which is radially distant from the central axis line Q by 3D/8 intersects with the boundary line S1, P3 designates an intersection point at which a phantom axis line designated by Q3 which is radially distant from the central axis line Q by D/2 intersects with the boundary line S1, an angle which a straight line joining the intersection points P0 and P1 makes with the central axis line Q is θ1, an angle which a straight line joining the intersection points P1 and P2 makes with the central axis line Q is θ2, and an angle which a straight line joining the intersection points P2 and P3 makes with the central axis line Q is θ3, the angle θ1, θ2 and θ3 are all larger than or equal to 70 degrees, and wherein, when an axial thickness along the central axis line Q of the weld portion is B, X designates an intersection point at which an extension of a contour line of the base material electrode in the vicinity of the weld portion intersects with a boundary line designated by S2 between the weld portion and the base material electrode, and an axial distance along the central axis line Q between the intersection points P3 and X is A, relational expressions of $B \geq 0.7A$ and $0.3\ \text{mm} \leq A \leq 0.6\ \text{mm}$ are satisfied.

The exemplary embodiment also provides a method of manufacturing the spark plug recited in claim 1, comprising the steps of:

laying the noble-metal chip on a distal end surface of the base material electrode; and applying a pulsed laser beam to a boundary portion between the base material electrode and the noble-metal chip while shifting a point of application of the pulsed laser bean in a circumferential direction of the boundary portion, wherein an angle of application of the pulsed laser beam to the boundary portion is in a range from ±10 degrees from a 90-degree angle with respect to the central axis line Q, and emission energy of the pulsed laser beam is maximum at a first pulse emission, and thereafter is gradually decreased with the increase of the number of times of pulse emission.

According to the exemplary embodiment, there is provided a spark plug including a noble-metal chip joined to abase material electrode which is excellent in the reliability in the joining between the noble-metal chip and the base material electrode, and can be manufactured at low cost.

Other advantages and features of the invention will become apparent from the following description including the drawings and claims.

PREFERRED EMBODIMENTS OF THE INVENTION

Embodiment 1

Figure 1:
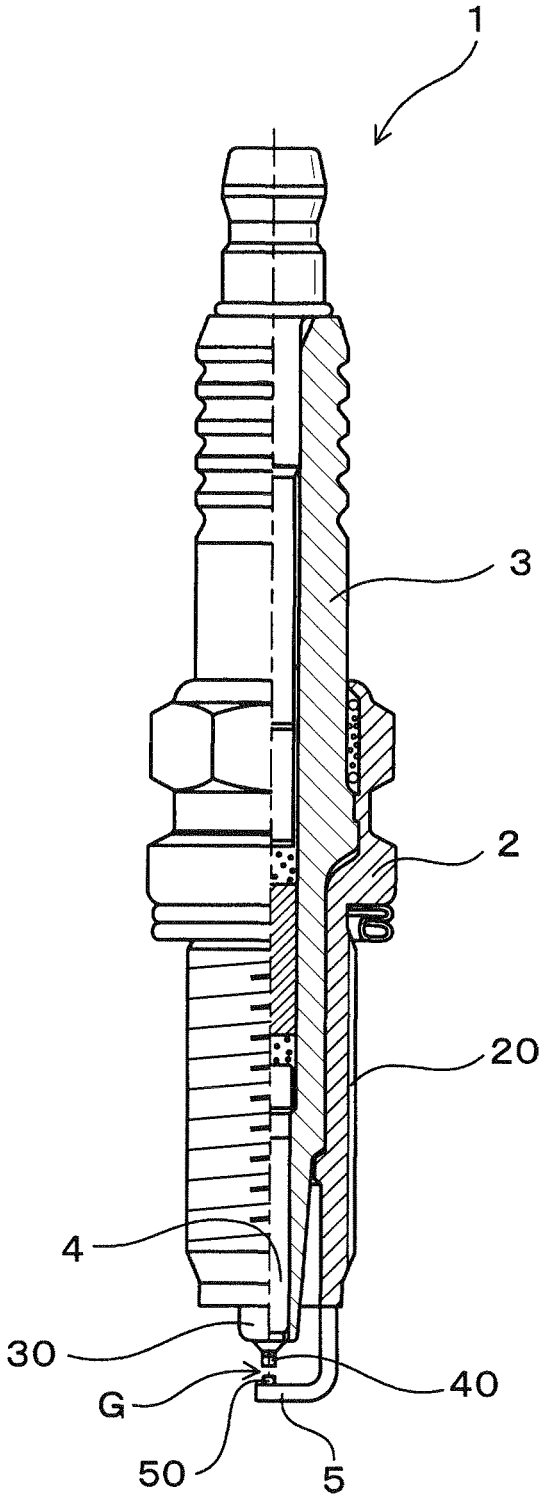
FIG. 1 is a partially cut longitudinal cross-section of a spark plug according to Embodiment 1 of the invention.

As shown in FIG. 1, a spark plug according to Embodiment 1 of the invention includes a center electrode 4, an insulator 3 disposed around the outer periphery of the center electrode 4, a mounting bracket 2 disposed around the outer periphery of the insulator 3 and a ground electrode 5 disposed so as to extend from the mounting bracket 2 and form a spark discharge gap G with the center electrode 4.

The mounting bracket 2 includes a mounting thread section 20 at its outer periphery. The insulator 3 accommodated in the mounting bracket 2 includes an insulator distal end portion 30 projecting more toward the front side of the spark plug 1 than the mounting bracket 2. A noble-metal chip 40 of a columnar shape having a diameter of D (mm) is joined to the distal end of the center electrode (base material electrode) 4 held inside the insulator 3 so as to project from the insulator distal end portion 30.

The ground electrode 5 disposed extending from the mounting bracket 2 is bent in an L-shape so as to face the noble-metal chip 40 of the center electrode 4 at its distal end. The ground electrode 5 is formed with a projecting portion 50 at a position facing the noble-metal chip 40 of the center electrode 4. The gap between the noble-metal chip 4 and the projecting portion 50 makes a spark discharge gap G. In this embodiment, the projecting portion 50 is made of the same material as the ground electrode 5. Alternatively, the projecting portion 50 may be made of a noble-material chip joined to the ground electrode 5.

The center electrode 4 and the ground electrode 5 are made of a Ni-based alloy having good heat resistance. The noble-metal chip 40 is made of an alloy containing Ir, Rh or Ru.

Figure 2:
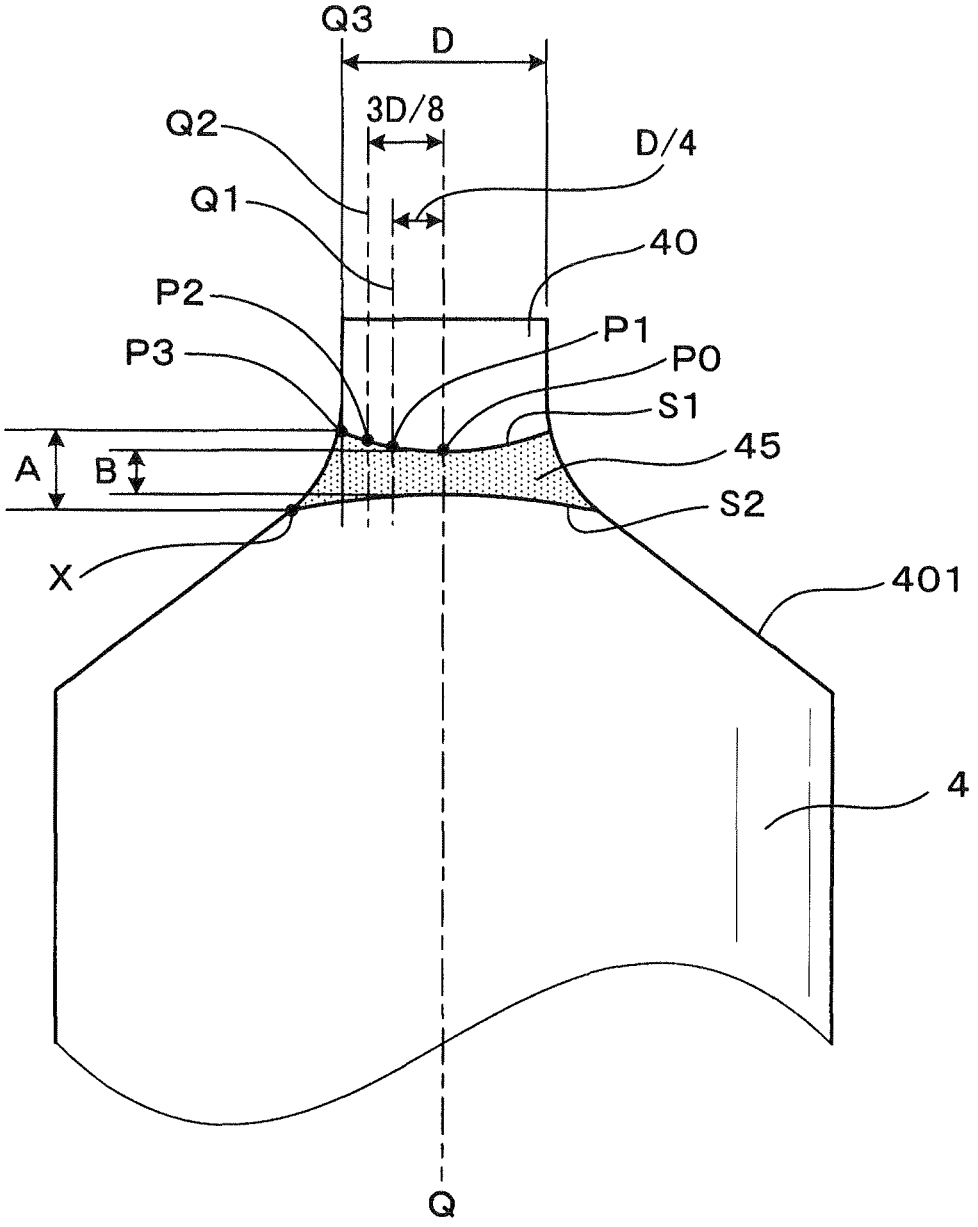
FIG. 2 is a diagram explaining the shape in the longitudinal cross-section of a weld portion between a center electrode (base material electrode) and a noble-metal chip of the spark plug according to Embodiment 1 of the invention.

In this embodiment, the noble-metal chip 40 is joined by welding to the distal end of the center electrode 4 as a base material electrode. That is, as shown in FIG. 2, the center electrode 4 and the noble-metal chip 40 are joined to each other through a weld portion 45. Next, the cross-sectional shape of the weld portion 45 is explained.

In FIG. 2 showing a partial cross section of the center electrode 4 passing through the central axis line Q of the center electrode 4, P0 designates an intersection point at which the central axis line Q and the boundary line S1 between the weld portion 45 and the noble-material chip 40 intersect with each other. P1 designates an intersection point at which a phantom axis line Q1 radially distant from the central axis line Q by D/4 and the boundary line S1 intersect with each other. P2 designates an intersection point at which a phantom axis line Q2 radially distant from the central axis line Q by 3D/8 and the boundary line S1 intersect with each other. P3 designates an intersection point at which a phantom axis line Q3 radially distant from the central axis line Q by D/2 and the boundary line S1 intersect with each other.

Figure 3:
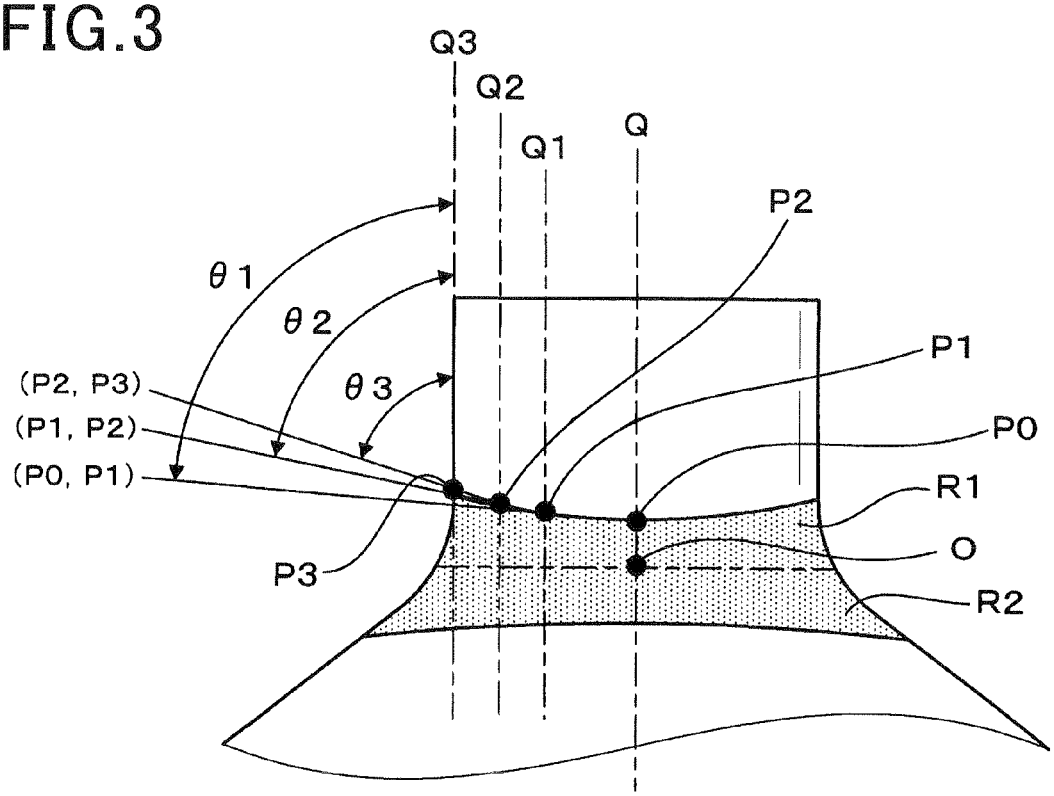
FIG. 3 is a diagram explaining definition of angles θ1 to θ3 in the shape in the longitudinal cross-section of the weld portion.

In FIG. 3 showing a partial cross section of the center electrode 4 passing through the central axis line Q, θ1 designates an angle (degree) which the straight line joining the intersection points P0 and P2 makes with the central axis line Q. θ2 designates an angle (degree) which the straight line joining the intersection points P1 and P2 makes with the central axis line Q. θ3 designates an angle (degree) which the straight line joining the intersection points P2 and P3 makes with the central axis line Q. In the spark plug 1 according to this embodiment, θ1, θ2 and θ3 are all greater than 70 degrees (requirement 1)

Returning to FIG. 2, B (mm) designates the axial thickness along the central axis line Q of the weld portion 45. X designates an intersection point at which an extension of the contour line of the center electrode 4 and the boundary line S2 between the weld portion 45 and the center electrode 4 intersect with each other. A (mm) designates an axial distance along the axis line Q between the intersection point P3 and the intersection point X. In the spark plug 1 according to this embodiment, the relationships of $B \geq 0.7A$ (requirement 2), and $0.3\ \text{mm} \leq A \leq 0.6\ \text{mm}$ (requirement 3) are satisfied.

In FIG. 3, R1 designates one of two regions which is closer to the noble-metal chip 40 (referred to as the first region R1 hereinafter) of the weld portion 45 separated by the orthogonal cross section passing through the midpoint O on the central axis line Q, and R2 designates the other of the two regions which is closer to the center electrode 4 (referred to as the second region R2 hereinafter). Here, it is assumed that the content of the chemical composition constituting the metal-noble chip 40 in the first region R1 is $C_1$ (mass %), and the content of the chemical composition constituting the metal-noble chip 40 in the second region R1 is $C_2$ (mass %). Also, it is assumed that the relationship of $|C_1 - C_2| \leq 20$ mass %. Each of the contents $C_1$ and $C_2$ can be obtained by measuring the chemical compositions at least at three points using an EPMA (Electron Probe MicroAnalyser), and calculating an average value of the measurements.

Next, a method of manufacturing the spark plug 1 having the above described structure is explained with reference to FIGS. 4 to 7. In this embodiment, the noble-metal chip 40 is joined to the distal end of the center electrode 4 as a base material electrode by the following steps.

Figure 4:
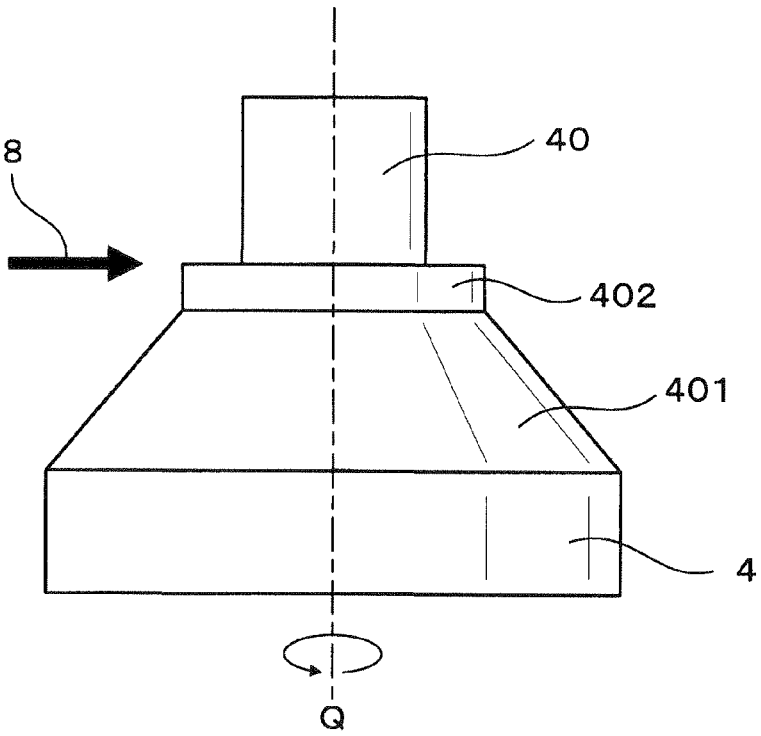
FIG. 4 is a diagram explaining a welding method between the center electrode (base material electrode) and the noble-metal chip.

First, the noble-metal chip 40 is laid on and pre-joined to the distal end of the center electrode 4 as shown in FIG. 4. In this embodiment, the center electrode 4 has a shape that includes a tapered surface 401 having a small-diameter end portion in its front end and a columnar pedestal portion 402 extending from the small-diameter end portion. The noble-metal chip 40 is placed aligned to the center of the pedestal portion 402, and pre-joined to the pedestal portion 402 by resistance welding.

Next, a pulsed laser beam 8 is applied to the boundary portion between the center electrode 4 and the noble-metal chip 40, while rotating the center electrode 4 around its central axis so that the point of application of the pulsed laser beam 8 shifts in the circumferential direction. The emission angle of the laser beam 8 is kept perpendicular (90 degrees) to the central axis line Q.

Figure 5:
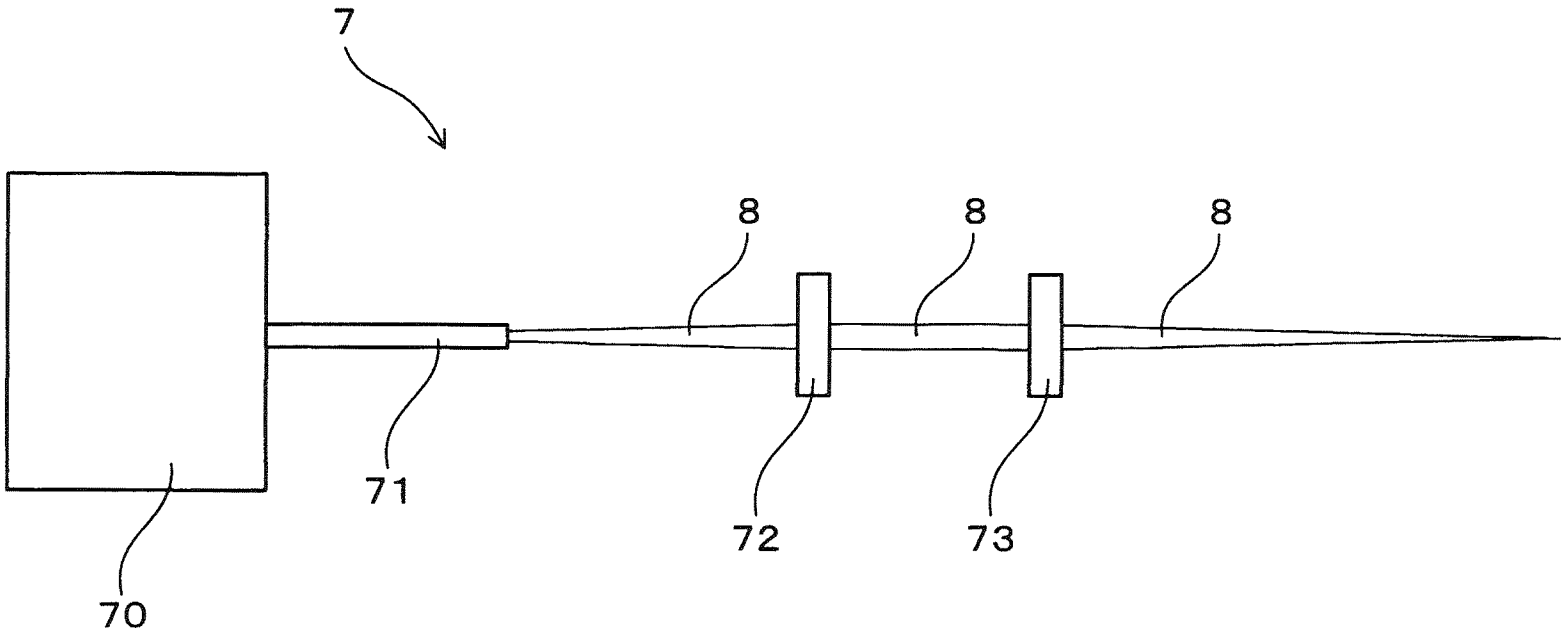
FIG. 5 is a diagram showing the structure of a laser beam emission apparatus used for welding between the center electrode and the noble-metal chip.

FIG. 5 shows the structure of a laser beam emission apparatus 7 used to emit a YAG laser beam as the laser beam 8. The laser beam emission apparatus 7 includes an oscillator 70 having a laser emission opening 71, a collimator lens section 72 having a focal length $F_1$ equal to 200 mm for collimating the emitted laser beam 8, and a collector lens section 73 having a focal length $F_2$ equal to 200 mm for collecting the collimated laser beam 8. The laser beam emission apparatus 7 is capable of reducing the laser spot diameter down to 0.15 mm. The laser beam emission apparatus 7 is the so-called CW laser oscillation apparatus capable of continuously emitting a laser beam. However, in this embodiment, the laser beam emission apparatus 7 is controlled to emit a pulsed laser beam.

Figure 6:
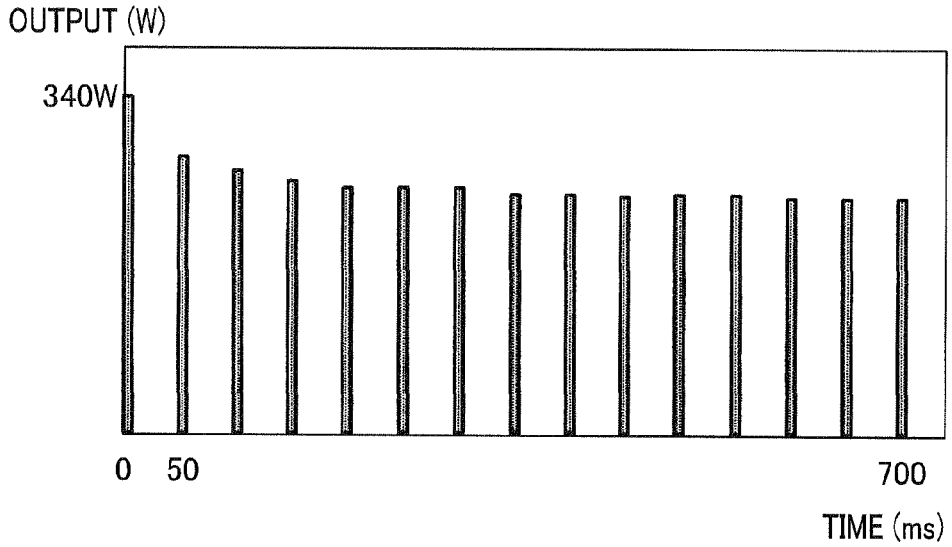
FIG. 6 is a diagram showing a temporal variation of energy of a pulsed laser beam emitted from the laser beam emission apparatus.

The laser beam 8 is emitted such that the emission energy is the highest at the first pulse emission, and is gradually decreased with the increase of the number of times of the pulse emission. More specifically, as shown in FIG. 6, the output power of the laser beam emission apparatus 7 is set to 340 W for the first pulse emission, decreased in the order of 280 W, 260 W and 250 W for the second to fourth pulse emissions, set to 240 W for the fifth to seventh pulse emissions, set to 230 W for eighth to twelfth pulse emissions, and set to 220 W for thirteenth to fifteenth pulse emissions.

The time duration of each pulse emission is 6 ms, and the cooling time from the end of one pulse emission to the start of the next pulse emission is 44 ms. The rotational speed of the center electrode 4 and the noble-metal chip 40 relative to the laser beam is 80 rpm so that the first to fifteenth pulse emissions are applied to fifteen points evenly spaced along the circumference of the center electrode 4 and the noble-metal chip 40.

Figure 7:
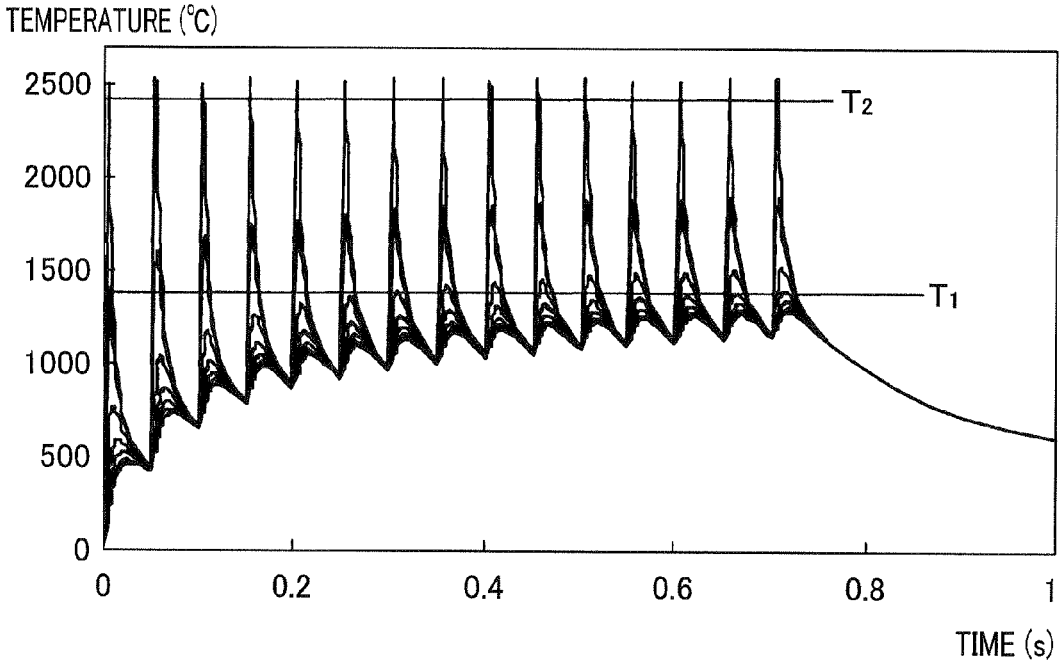
FIG. 7 is a diagram showing a temporal variation of the temperature of the weld portion due to application of the pulsed laser beam.

FIG. 7 shows simulation results of temporal variation of the temperature of the weld portion 45 due to applications of the pulsed laser beam. In FIG. 7, the horizontal axis represents time and the vertical axis represents the temperature of the weld portion 45. Here, the temperature of the weld portion 45 is defined as the maximum of different temperatures of different parts of the weld portion 45. In FIG. 7, $T_1$ (° C.) denotes the melting point of the center electrode 4, and $T_2$ (° C.) denotes the melting point of the noble-metal chip 40. As seen from FIG. 7, the temperature of the weld portion 45 exceeds the melting point $T_2$ of the noble-metal chip 40 after each application of the pulsed beam, and thereafter decreases below the melting point $T_1$ of the center electrode 4 before the next application of the pulsed beam.

Figure 8:
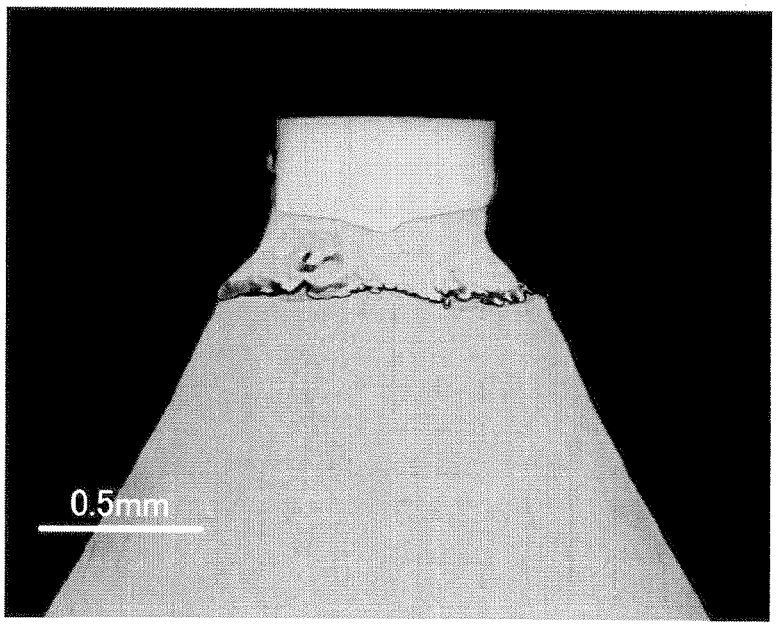
FIG. 8 is a photograph showing the longitudinal cross-section of the weld portion between the center electrode and the noble-metal chip of the spark plug according to Embodiment 1 of the invention.

FIG. 8 is a photograph showing the longitudinal cross-section of the weld portion 45 between the center electrode 4 and the noble-metal chip 40 obtained by the above described method. In FIG. 8, the noble-metal chip 40 is shown in the upper side, the weld portion 45 is shown in the middle side, and the tapered portion of the center electrode 4 as a base material electrode is shown in the lower side. As seen from FIG. 8, since the thickness variation along the radial direction of the weld portion 45 is small, the foregoing requirements 1 to 3 are satisfied.

For each of the first region R1 and the second region R2 constituting the weld portion 45, the chemical compositions were measured at three different points, and the average value was calculated. As a result, it was found that the first region R1 contains Ir, which is the composition of the noble-metal chip, by 55 mass % on average, and the second region R2 contains Ir by 38 mass % on average. Accordingly, it was confirmed that $|C_1-C_2|=17$ mass % which is lower than 20 mass %.

As described above, the spark plug 1 according to this embodiment satisfies the first requirement that the angles θ1, θ2 and θ3 are all greater than 70 degrees, and the second requirement of $B \geq 0.7A$ where B is the axial thickness and A is the axial distance. Accordingly, the thickness variation along the radial direction of the spark plug 1 can be made small. More specifically, although the axial thickness of the weld portion 45 becomes smaller in the direction from its outer periphery to its axial center, it is possible to prevent the thickness variation from becoming excessively abrupt. Since this makes it possible to lessen the thermal stress applied between the weld portion 45 and the noble-metal chip 40 or the center electrode 4, the reliability of the joining between them can be increased.

Further, since the weld portion 45 satisfies that the difference between $C_1$ and $C_2$ is smaller than 20 mass %, it is possible to prevent cracks from being formed by the thermal stress due to non-uniformity of the chemical compositions of the weld portion 45.

The spark plug 1 satisfies, in addition to the first and second requirements, the third requirement of $0.3\ \text{mm} \leq A \leq 0.6\ \text{mm}$ where A is the axial distance A. Accordingly, since the volume of the weld portion 45 can be limited within an appropriate value, it is possible to reduce an amount of the noble-metal chip necessary to form the weld portion 45. Since this makes it possible to reduce a use amount of the expensive noble-metal chip 45, the manufacturing cost of the spark plug 1 can be reduced.

In the method of manufacturing the spark plug 1 described above, the angle of application of the pulsed laser beam 8 to the boundary portion between the center electrode 4 and the noble-metal chip 40 is set substantially perpendicular to the central axis line Q. This makes it possible to suppress the shape of the weld portion 45 from suffering due to the effect of the angle of application of the laser beam.

As described in the foregoing, the laser beam 8 is emitted such that the emission energy is the highest at the first pulse emission, and is gradually decreased with the increase of the number of times of the pulse emission. This makes it possible to prevent the weld portion from becoming excessively large due to overlap of the heat brought by one emission of the laser beam and the succeeding emission of the laser beam. Hence, according to this embodiment, it is easy to form the weld portion 45 having the above described specific shape.

Further, since the laser beam emission apparatus 7 used in this embodiment excels in beam collection, and is capable of forming a laser beam spot of a very small diameter, shape control of the weld portion 45 can be performed accurately.

Comparative Example 1

Figure 9:
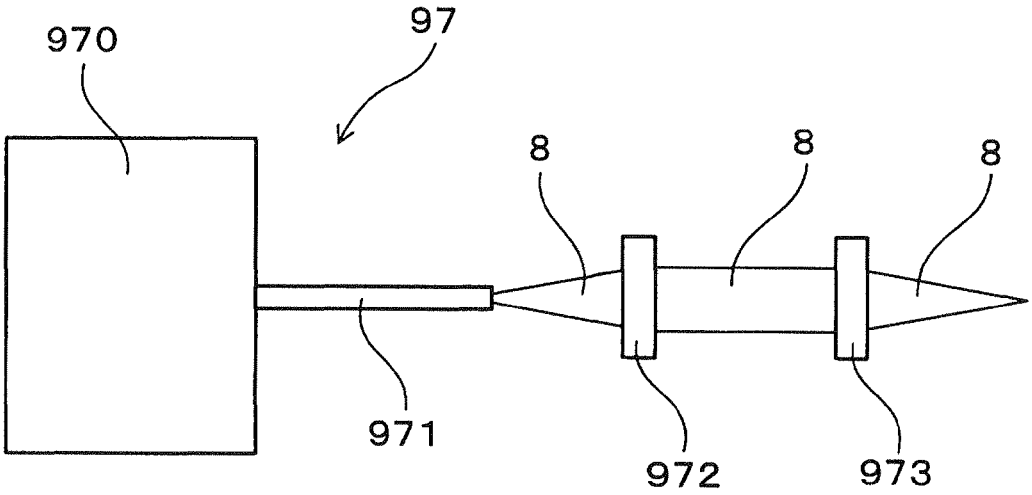
FIG. 9 is a diagram showing the structure of a laser beam emission apparatus used for welding between a center electrode (base material electrode) and a noble-metal chip of a spark plug as comparative Example 1.

An example of the weld portion formed between the center electrode 4 and the noble-metal chip 40 not satisfying the requirements 1 to 3 is shown in the following as comparative Example 1. FIG. 9 shows the structure of a laser beam emission apparatus 97 used in this comparative Example 1. The laser beam emission apparatus 97 includes an oscillator 970 having a laser emission opening 971, a collimator lens section 972 having a focal length $F_1$ equal to 90 mm for collimating the emitted laser beam 8, and a collector lens section 973 having a focal length $F_2$ equal to 90 mm for collecting the collimated laser beam 8. The laser beam emission apparatus 97 is inferior to the laser beam emission apparatus 7 used in Embodiment 1 in the beam collecting characteristics, and the laser beam spot diameter of this laser beam emission apparatus 97 is 0.4 mm at minimum.

In this comparative Example 1, the pulsed laser beam is applied at an angle of 90 degrees with respect to the central axis line Q (see FIG. 4) to the boundary portion between the noble-metal chip 40 and the center electrode 4 which is being relatively rotated. The emission energy of the pulsed laser beam is kept constant.

Figure 10:
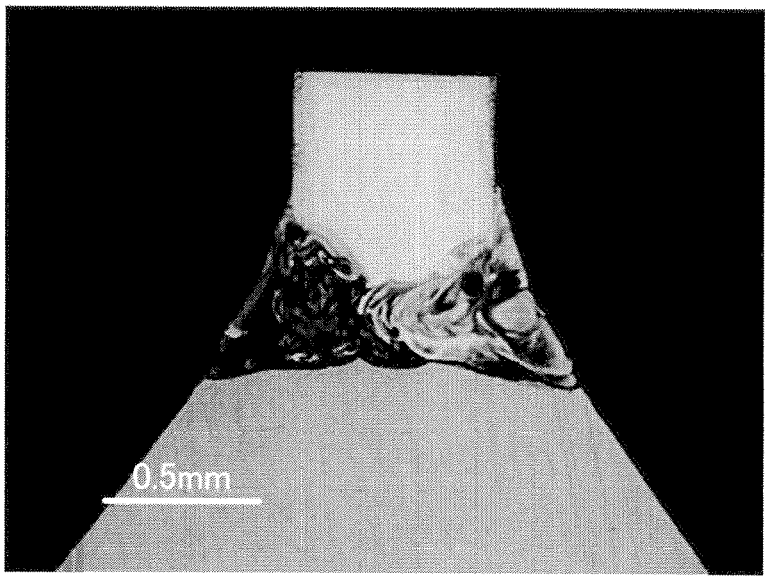
FIG. 10 is a photograph showing the longitudinal cross-section of the weld portion between the center electrode and the noble-metal chip of the spark plug of Comparative Example 1.

FIG. 10 is a photograph showing the longitudinal cross-section of the weld portion 45 between the center electrode 4 and the noble-metal chip 40 of this comparative Example 1. In FIG. 10, the noble-metal chip 40 is shown in the upper side, the weld portion 45 is shown in the middle side, and the tapered portion of the center electrode 4 as a base material electrode is shown in the lower side. As seen from FIG. 10, the thickness variation along the radial direction of the weld portion 45 is far larger than that in Embodiment 1, and the requirements 1 to 3 are not satisfied.

Evaluation Simulation 1

Figure 11:
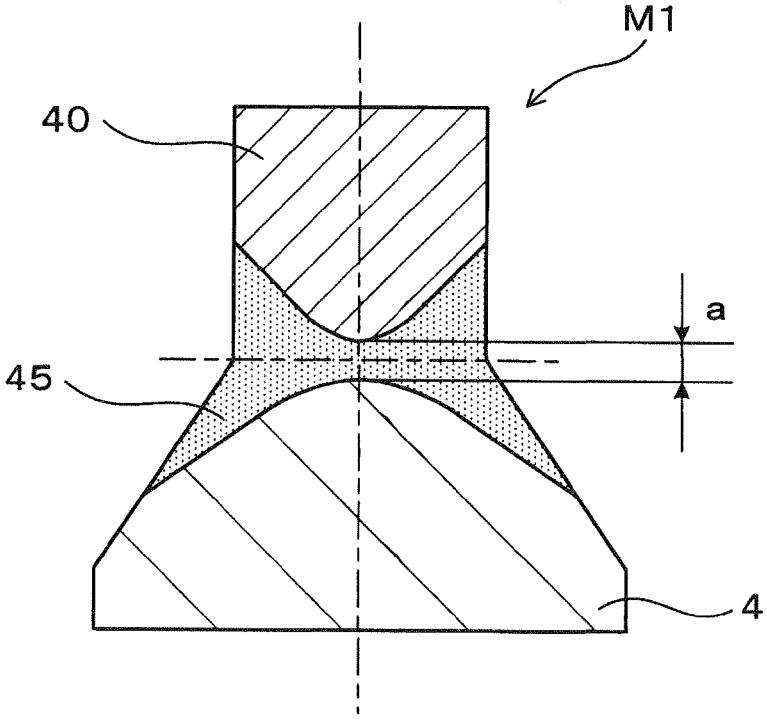
FIG. 11 is a diagram showing, as a first model shape, a modeled version of the spark plug according to Comparative Example.
Figure 12:
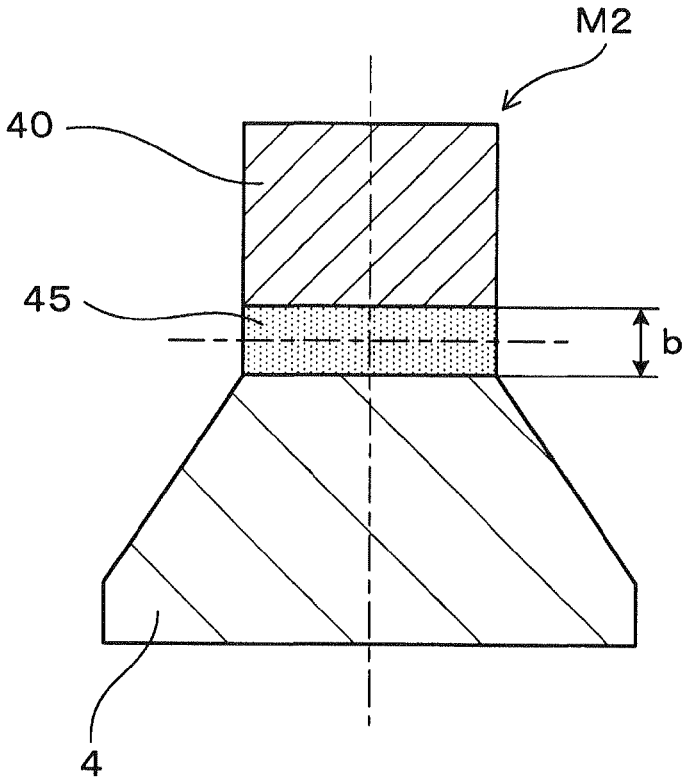
FIG. 12 is a diagram showing, as a second model shape, a modeled version of the spark plug according to Embodiment 1.

FIG. 11 is a diagram showing a modeled version M1 of the comparative Example 1 in which the thickness of the weld portion 45 is a at its center, and increases toward its outer periphery. FIG. 12 is a diagram showing another modeled version M2 of the Embodiment 1 in which the thickness of the weld portion 45 is constant at b along the radial direction. In this evaluation Simulation 1, the value of the thermal stress assumed to occur in use is acquired for each of the cases where the value of the thickness a is a1 (0.2 mm), a2 (0.4 mm) and a3 (0.6 mm), and for each of the cases where the value of the thickness b is b1 (0.2 mm), b2 (0.4 mm) and b3 (0.6 mm). The results are shown in Table 1 and FIG. 13.

TABLE 1

| model No. | model shape | dimension of a or b (mm) | stress (MPa) |
|---|---|---|---|
| a1 | M1 (FIG. 11) | 0.2 | 2662 |
| a2 | M1 (FIG. 11) | 0.4 | 3345 |
| a3 | M1 (FIG. 11) | 0.6 | 3248 |
| b1 | M2 (FIG. 12) | 0.2 | 1367 |
| b2 | M2 (FIG. 12) | 0.4 | 1248 |
| b3 | M2 (FIG. 12) | 0.6 | 1236 |

Figure 13:
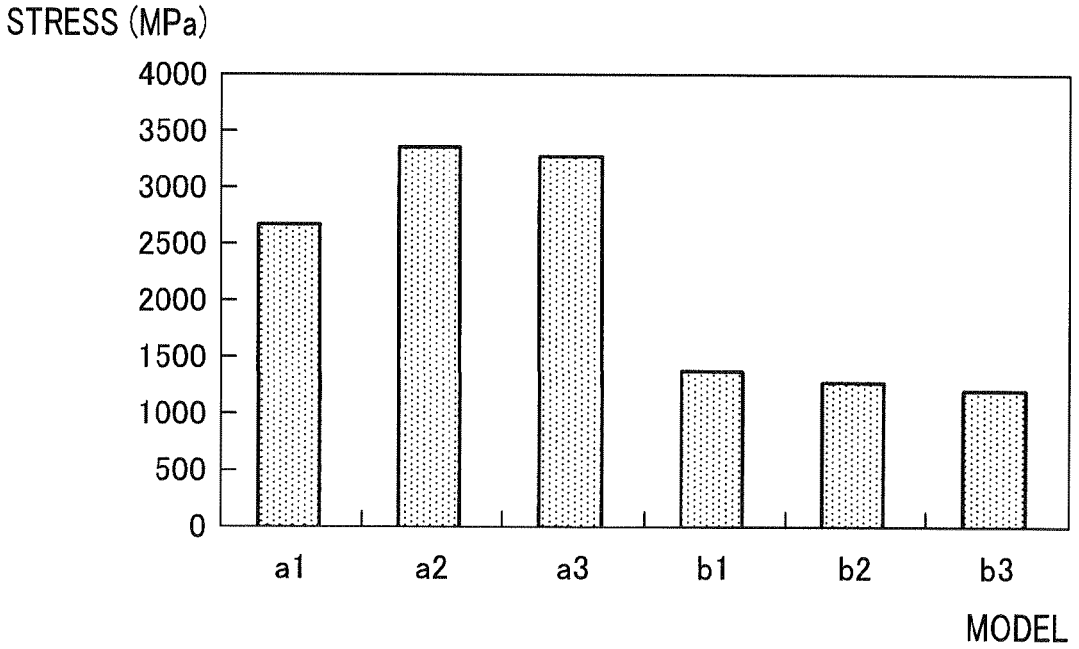
FIG. 13 is a diagram showing, for different thicknesses of the weld portion, values of the thermal stress occurred in the first and second model shapes.

As seen from Table 1 and FIG. 13, the thermal stress assumed to occur in the weld portion having the shape shown in FIG. 12 is much smaller than that shown in FIG. 11. Therefore, it can be inferred that the spark plug whose shape is closer to the model shape M2 shown in FIG. 12 than to the model shape M1 shown in FIG. 11 is applied with less thermal stress in use, and accordingly has excellent durability.

Incidentally, noble-metal chip 40 is joined to the center electrode 4 in the above described embodiment, however, the noble metal-chip 40 may be joined to the ground electrode 5.

Evaluation Simulation 2

Figure 14:
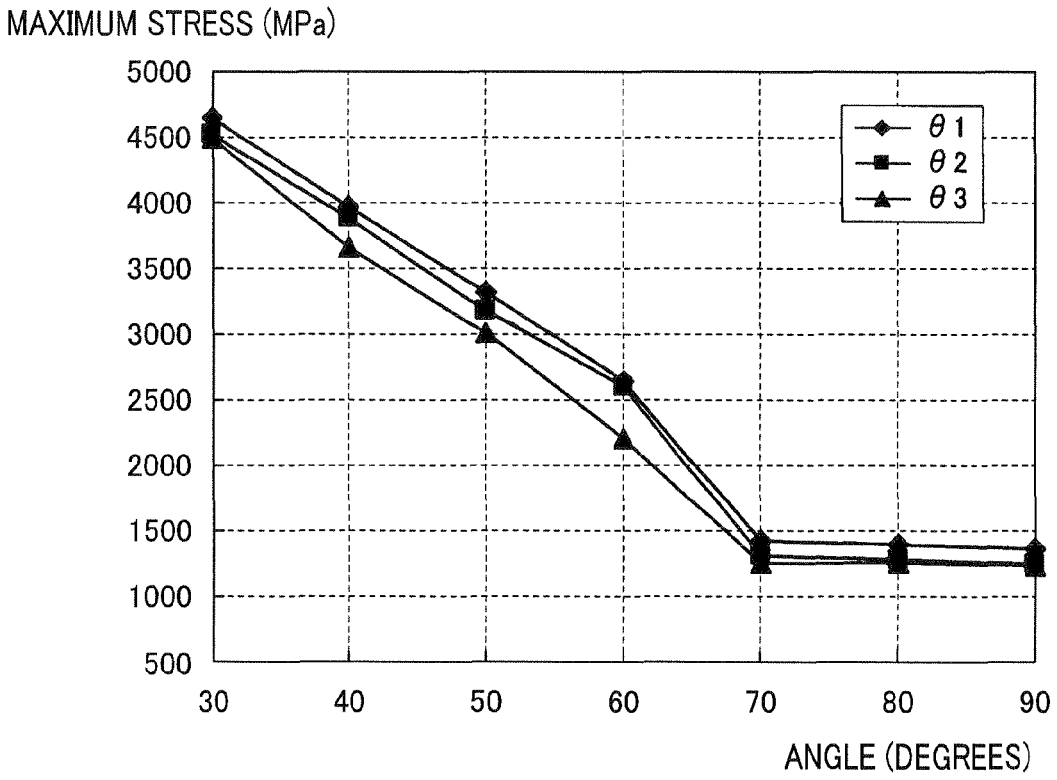
FIG. 14 is a diagram showing a relationship between the angles θ1 to θ3 and the maximum thermal stress in the spark plug according to Embodiment 1 of the invention.

FIG. 14 is a diagram showing relationships between the maximum thermal stress applied between the weld portion 45 and the noble-metal chip 40 or center electrode 4 and various values of each of the angles θ1, θ2 and θ3 in the spark plug according to Embodiment 1. This simulation is made assuming that the axial thickness B along the central axis line Q of the weld portion 45 shown in FIG. 2 is constant at 0.3 mm, the curvature of the boundary line S1 is constant along its whole length, and the tangent of the boundary line S1 at the point P0 is orthogonal to the central axis line Q. By determining one of the angles θ1, θ2 and θ3, the curvature of the boundary line S1 is determined. Incidentally, the boundary line S2 is assumed to be a line symmetrical to the boundary line S1 with respect to the straight line passing through the midpoint O on the central axis line Q of the weld portion 45.

As seen from FIG. 14, if at least one of the angles θ1, θ2 and θ3 is smaller than 70 degrees, the maximum thermal stress increases with the decrease of this small angle, and if the angles θ1, θ2 and θ3 are all larger than or equal to 70 degrees, the maximum thermal stress can be suppressed reliably.

In the above described Embodiment 1, the emission energy of the pulsed laser beam is decreased with the increase of the number of times of the pulse emission to remove the effect of heat accumulation. However, the way to remove the effect of heat accumulation may be achieved by increasing the interval of the pulse emission or by provision of a cooling means. In these cases, the emission energy of the pulsed laser beam can be constant.

The above explained preferred embodiments are exemplary of the invention of the present application which is described solely by the claims appended below. It should be understood that modifications of the preferred embodiments may be made as would occur to one of skill in the art.

What is claimed is:

1. A spark plug for an internal combustion engine comprising:

a center electrode;

an insulator disposed around an outer periphery of the center electrode;

a mounting bracket disposed around an outer periphery of the insulator;

a ground electrode disposed so as to extend from the mounting bracket and form a spark discharge gap with the center electrode; and a columnar noble-metal chip having a diameter of D and joined, through a weld portion, to a distal end of at least one of the center electrode and the ground electrode as a base material electrode, wherein, when Q designates a central axis line of the noble-metal chip, P0 designates an intersection point in a cross-section of the noble-metal chip passing through the central axis line Q at which the central axis line Q intersects with a boundary line designated by S1 between the weld portion and the noble-metal chip, P1 designates an intersection point at which a phantom axis line designated by Q1 which is radially distant from the central axis line Q by D/4 intersects with the boundary line S1, P2 designates an intersection point at which a phantom axis line designated by Q2 which is radially distant from the central axis line Q by 3D/8 intersects with the boundary line S1, P3 designates an intersection point at which a phantom axis line designated by Q3 which is radially distant from the central axis line Q by D/2 intersects with the boundary line S1, an angle which a straight line joining the intersection points P0 and P1 makes with the central axis line is θ1, an angle which a straight line joining the intersection points P1 and P2 makes with the central axis line Q is θ2, and an angle which a straight line joining the intersection points P2 and P3 makes with the central axis line Q is θ3, the angle θ1, θ2 and θ3 are all larger than or equal to 70 degrees, and wherein, when an axial thickness along the central axis line Q of the weld portion is B, X designates an intersection point at which an extension of a contour line of the base material electrode in the vicinity of the weld portion intersects with a boundary line designated by S2 between the weld portion and the base material electrode, and an axial distance along the central axis line Q between the intersection points P3 and X is A, relational expressions of $B \geq 0.7A$ and $0.3\ mm \leq A \leq 0.6\ mm$ are satisfied, and wherein when the weld portion is separated into a first region and a second region by a cross-section which passes through a midpoint of the central axis line Q and is perpendicular to the central axis line Q, the first region being closer to the noble-metal chip than to the base material electrode, the second region being closer to the base material electrode than to the noble-metal chip, and when a content of a chemical composition constituting the noble-metal chip in the first region is $C_1$ mass % and a content of the chemical composition constituting the noble-metal chip in the second region is $C_2$ mass %, a relational expression of $|C_1-C_2| \leq 20$ mass % is satisfied.

2. A method of manufacturing a spark plug for an internal combustion engine, the spark plug comprising:

a center electrode;

an insulator disposed around an outer periphery of the center electrode;

a mounting bracket disposed around an outer periphery of the insulator;

a ground electrode disposed so as to extend from the mounting bracket and form a spark discharge gap with the center electrode; and a columnar noble-metal chip having a diameter of D and joined, through a weld portion, to a distal end of at least one of the center electrode and the ground electrode as a base material electrode, wherein, when Q designates a central axis line of the noble-metal chip, P0 designates an intersection point in a cross-section of the noble-metal chip passing through the central axis line Q at which the central axis line Q intersects with a boundary line designated by S1 between the weld portion and the noble-metal chip, P1 designates an intersection point at which a phantom axis line designated by Q1 which is radially distant from the central axis line Q by D/4 intersects with the boundary line S1, P2 designates an intersection point at which a phantom axis line designated by Q2 which is radially distant from the central axis line Q by 3D/8 intersects with the boundary line S1, P3 designates an intersection point at which a phantom axis line designated by Q3 which is radially distant from the central axis line Q by D/2 intersects with the boundary line S1, an angle which a straight line joining the intersection points P0 and P1 makes with the central axis line Q is θ1, an angle which a straight line joining the intersection points P1 and P2 makes with the central axis line Q is θ2, and an angle which a straight line joining the intersection points P2 and P3 makes with the central axis line is Q is θ3, the angle θ1, θ2 and θ3 are all larger than or equal to 70 degrees, and wherein, when an axial thickness along the central axis line Q of the weld portion is B, X designates an intersection point at which an extension of a contour line of the base material electrode in the vicinity of the weld portion intersects with a boundary line designated by S2 between the weld portion and the base material electrode, and an axial distance alone the central axis line Q between the intersection points P3 and X is A, relational expressions of $B \geq 0.7A$ and $0.3\ mm \leq A \leq 0.6\ mm$ are satisfied; and wherein the method of manufacturing the spark plug comprises the steps of:

laying the noble-metal chip on a distal end surface of the base material electrode; and applying a pulsed laser beam to a boundary portion between the base material electrode and the noble-metal chip while shifting a point of application of the pulsed laser bean in a circumferential direction of the boundary portion, wherein an angle of application of the pulsed laser beam to the boundary portion is in a range from ±10 degrees from a 90-degree angle with respect to the central axis line Q, and emission energy of the pulsed laser beam is maximum at a first pulse emission, and thereafter is gradually decreased with the increase of the number of times of pulse emission.

3. The method according to claim 2, wherein the pulsed laser beam is emitted such that after a temperature of the weld portion due to one pulse emission falls from above a melting point of the noble-metal chip to below a melting point of the base material electrode, a next pulse emission is made.

4. The method according to claim 2, wherein the pulsed laser beam is emitted so as to have a spot diameter of 0.2 mm or less.

* * * * *